US009601106B2

(12) United States Patent
Mori et al.

(10) Patent No.: US 9,601,106 B2
(45) Date of Patent: Mar. 21, 2017

(54) PROSODY EDITING APPARATUS AND METHOD

(71) Applicant: KABUSHIKI KAISHA TOSHIBA, Minato-ku, Tokyo (JP)

(72) Inventors: Kouichirou Mori, Saitama (JP); Takehiko Kagoshima, Yokohama (JP); Masahiro Morita, Yokohama (JP)

(73) Assignee: Kabushiki Kaisha Toshiba, Minato-ku, Tokyo (JP)

( * ) Notice: Subject to any disclaimer, the term of this patent is extended or adjusted under 35 U.S.C. 154(b) by 225 days.

(21) Appl. No.: 13/968,154

(22) Filed: Aug. 15, 2013

(65) Prior Publication Data

US 2014/0052446 A1 Feb. 20, 2014

(30) Foreign Application Priority Data

Aug. 20, 2012 (JP) ..... 2012-181616

(51) Int. Cl.

*G10L 13/00* (2006.01)
*G10L 13/10* (2013.01)
*G10L 13/08* (2013.01)

(52) U.S. Cl.

CPC ..... *G10L 13/10* (2013.01); *G10L 13/08* (2013.01)

(58) Field of Classification Search

CPC ..... G10L 13/033; G10L 13/08; G10L 13/10
USPC ..... 704/258–269
See application file for complete search history.

(56) References Cited

U.S. PATENT DOCUMENTS 5,463,713 A * 10/1995 Hasegawa ..... 704/260
5,796,916 A * 8/1998 Meredith ..... 704/258
5,842,167 A * 11/1998 Miyatake et al. ..... 704/260
6,470,316 B1 * 10/2002 Chihara ..... 704/267
6,778,962 B1 * 8/2004 Kasai et al. ..... 704/266
7,571,099 B2 * 8/2009 Saito et al. ..... 704/268
2001/0032078 A1 * 10/2001 Fukada ..... 704/258
(Continued)

FOREIGN PATENT DOCUMENTS

CN 101276584 A 10/2008
CN 101622659 A 1/2010
(Continued)

OTHER PUBLICATIONS

Japanese First Office Action dated Feb. 10, 2015 from corresponding Japanese Patent Application No. 2014-150385, 3 pages.
(Continued)

*Primary Examiner* — Shaun Roberts
(74) *Attorney, Agent, or Firm* — Ohlandt, Greeley, Ruggiero & Perle, L.L.P.

(57) ABSTRACT

According to one embodiment, a prosody editing apparatus includes a storage, a first selection unit, a search unit, a normalization unit, a mapping unit, a display, a second selection unit, a restoring unit and a replacing unit. The search unit searches the storage for one or more second prosodic patterns corresponding to attribute information that matches attribute information of the selected phrase. The mapping maps each of the normalized second prosodic patterns on a low-dimensional space. The restoring unit restores a restored prosodic pattern according to the selected coordinates. The replacing unit replaces prosody of synthetic speech generated based on the selected phrase by the restored prosodic pattern.

17 Claims, 18 Drawing Sheets

(56) References Cited

U.S. PATENT DOCUMENTS

| | | | | |
|---|---|---|---|---|
| 2003/0158721 | A1* | 8/2003 | Kato et al. | 704/1 |
| 2005/0114137 | A1* | 5/2005 | Saito et al. | 704/260 |
| 2005/0267758 | A1* | 12/2005 | Shi et al. | 704/260 |
| 2008/0167875 | A1* | 7/2008 | Bakis et al. | 704/258 |
| 2008/0243508 | A1 | 10/2008 | Masuko et al. | |
| 2010/0250257 | A1 | 9/2010 | Hirose et al. | |
| 2011/0054902 | A1* | 3/2011 | Li et al. | 704/258 |
| 2012/0166198 | A1* | 6/2012 | Lin et al. | 704/260 |

FOREIGN PATENT DOCUMENTS

| | | | |
|---|---|---|---|
| JP | 2001-5477 | A | 1/2001 |
| JP | 2008-268477 | A | 11/2008 |
| JP | 4-296231 | B2 | 7/2009 |
| JP | 2010-60886 | A | 3/2010 |

OTHER PUBLICATIONS

Chinese First Office Action dated Dec. 3, 2015 from corresponding Chinese Application No. 201310364756.X; 17 pages.

* cited by examiner 201 202 203 204 206

205

| ID | Surface expression | Phoneme sequence | Mora count and accent type | Pattern count |
|---|---|---|---|---|
| 1 | 下さい | /K/U/D/A/S/A/I/ | 4 moras/type 3 | 182 |
| 2 | お待ちください | /O/M/A/CHI/K/U/D/A/S/A/I/ | 7 moras/type 6 | 61 |
| 3 | お願いします | /O/N/E/G/A/I/SH/I/M/A/SU/ | 7 moras/type 6 | 75 |
| 4 | いかがでしょう | /I/K/A/G/A/D/E/SH/O/O/ | 6 moras/type 2 | 16 |
| 5 | いただけますか | /I/T/A/D/A/K/E/M/A/SU/K/A/ | 7 moras/type 5 | 41 |
| 6 | ございますか | /G/O/Z/A/I/M/A/SU/K/A/ | 6 moras/type 4 | 12 |
| 7 | なります | /N/A/R/I/M/A/SU/ | 4 moras/type 3 | 102 |
| 8 | いらっしゃいませ | /I/R/A/SH/A/I/M/A/S/E/ | 7 moras/type 6 | 164 |
| 9 | いかがですか | /I/K/A/G/A/D/E/SU/K/A/ | 6 moras/type 2 | 41 |
| 10 | そうですか | /S/O/O/D/E/SU/K/A/ | 5 moras/type 1 | 50 |
| 11 | 思います | /O/M/O/I/M/A/SU/ | 5 moras/type 4 | 142 |
| 12 | ですね | /D/E/SU/N/E/ | 3 moras/type 1 | 15 |
| 13 | ありますか | /A/R/I/M/A/SU/K/A/ | 5 moras/type 3 | 11 |
| 14 | Please | /p/I/ii/z | | 7 |

FIG. 2

| ID (201) | PID (301) | Fundamental frequency (302) | Duration (303) |
|---|---|---|---|
| 9 | 1 | [284, 278, 273, 266, 261, 259, 255, ...] | [12, 12, 11, 7, 9, 9, 9, 18, 12, 23] |
| 9 | 2 | [223, 223, 223, 223, 222, 222, 222, ...] | [11, 14, 11, 5, 12, 7, 16, 12, 16, 25] |
| 9 | 3 | [175, 181, 187, 192, 197, 193, 189, ...] | [9, 12, 11, 9, 14, 5, 14, 12, 14, 33] |
| 9 | 4 | [284, 282, 280, 278, 276, 274, 272, ...] | [12, 16, 14, 5, 11, 9, 12, 16, 16, 29] |
| ... | ... | ... | ... |

FIG. 3

703

X =

| 701 | 702 |
|---|---|
| 1.64, 1.68, 1.69, 1.66, 1.59, 1.53, 1.53, ... | 0.08, -0.83, -0.45, -1.41, 0.71, ... |
| 0.20, 0.22, 0.23, 0.25, 0.27, 0.30, 0.34, ... | -0.20, 0.05, -0.45, -0.04, -1.41, ... |
| -1.91, -1.95, -1.95, -1.89, -1.77, -1.64, -1.45, ... | -0.77, -0.83, -0.45, 0.89, 1.04, ... |
| 0.37, 0.37, 0.37, 0.36, 0.35, 0.36, 0.38, ... | 0.08, 0.95, 0.75, -0.98, -0.42, ... |
| ... | ... |

FIG. 7

| 201 ID | 301 PID | 302 Fundamental frequency | 303 Duration | 1401 Label |
|---|---|---|---|---|
| 9 | 1 | [284, 278, 273, 266, 261, 259, 255, ...] | [12, 12, 11, 7, 9, 9, 9, 18, 12, 23] | Normal |
| 9 | 2 | [223, 223, 223, 223, 222, 222, 222, ...] | [11, 14, 11, 5, 12, 7, 16, 12, 16, 25] | Normal |
| 9 | 3 | [175, 181, 187, 192, 197, 193, 189, ...] | [9, 12, 11, 9, 14, 5, 14, 12, 14, 33] | Question |
| 9 | 4 | [284, 282, 280, 278, 276, 274, 272, ...] | [12, 16, 14, 5, 11, 9, 12, 16, 16, 29] | Anger |
| ... | ... | ... | ... | ... |

F I G. 14

PROSODY EDITING APPARATUS AND METHOD

CROSS-REFERENCE TO RELATED APPLICATIONS

This application is based upon and claims the benefit of priority from Japanese Patent Application No. 2012-181616, filed Aug. 20, 2012, the entire contents of which are incorporated herein by reference.

FIELD

Embodiments described herein relate generally to a prosody editing apparatus and method.

BACKGROUND

In recent years, along with the development of a speech synthesis technique which synthesizes speech from text, natural synthetic speech close to human voice production can be obtained.

A recent speech synthesis system generally uses a method of learning prosody or voice quality statistical model from a speech corpus of recorded human speech data. For example, as a prosody statistical model, a decision tree model, hidden Markov model, and the like are known. Using these statistical models, intonation of arbitrary text which is not included in a learning corpus can be reproduced naturally to some extent.

However, since the statistical model learns average prosodic features from many utterances in the speech corpus, intonation of synthetic speech generated from the statistical model tends to be monotonic. Hence, a system which visually presents a prosodic pattern generated by the statistical model to the user, and allows the user to graphically edit the pattern using a device such as a mouse is known.

BRIEF DESCRIPTION OF THE DRAWINGS

FIG. 2 is a table illustrating an example of attribute information of phrases stored in a prosodic pattern database (DB);

FIG. 3 is a table illustrating an example of prosodic patterns stored in the prosodic pattern DB;

FIG. 7 is a view for explaining mapping processing of a prosodic pattern mapping unit;

FIG. 14 is a table illustrating an example of prosodic patterns stored in a prosodic pattern DB according to the third modification;

DETAILED DESCRIPTION

Figure 1:
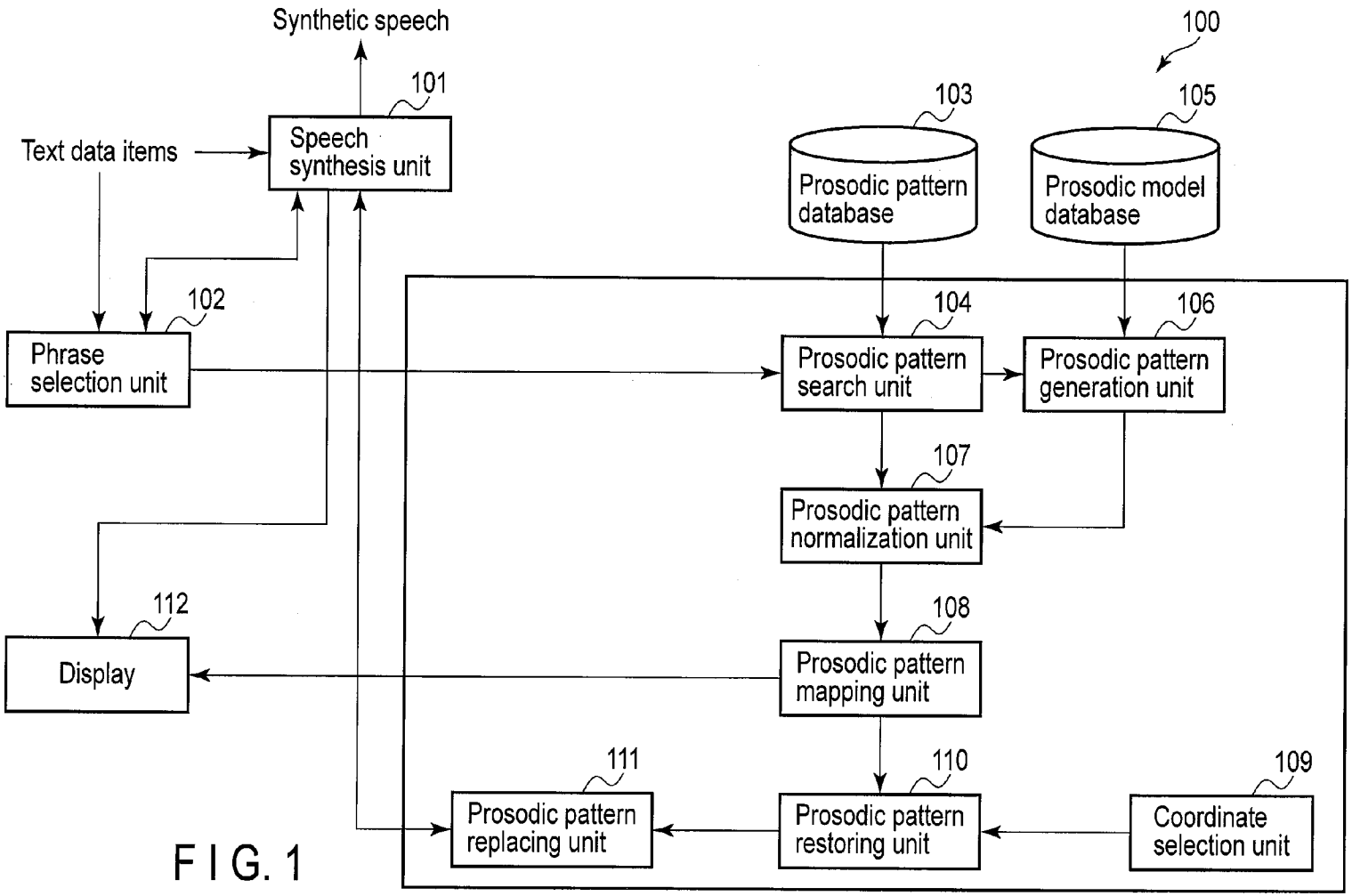
FIG. 1 is a block diagram illustrating a prosody editing apparatus according to the first embodiment.

Graphical editing allows to create arbitrary prosodies as long as they can be output as synthetic speech. Hence, prosodic pattern editing has a high degree of freedom in editing, but improper prosodic patterns are unwantedly created. That is, it is very difficult for a user who has no knowledge about speech to create an intended prosodic pattern.

In order to solve the problem of the degree of freedom, a method of compressing a parameter space having a very high degree of freedom to a two-dimensional coordinate plane is available. However, since not a prosodic pattern of a phrase but a voice quality of synthetic speech can be edited, an editing target is different, and this method cannot be used for the purpose of editing fundamental frequency and duration of an arbitrary text phrase.

In general, according to one embodiment, a prosody editing apparatus includes a storage, a first selection unit, a search unit, a normalization unit, a mapping unit, a display, a second selection unit, a restoring unit and a replacing unit. The storage is configured to store attribute information items of phrases and one or more first prosodic patterns corresponding to each of the attribute information items of the phrases, the attribute information items each indicating an attribute associated with a phrase, the first prosodic patterns each including parameters which indicate a prosody type of the phrase and expresses prosody of the phrase, the parameters each including elements not less than the number of phonemes of the phrase. The first selection unit is configured to select a phrase including phonemes from text to obtain a selected phrase. The search unit is configured to search the storage for one or more second prosodic patterns corresponding to an attribute information item that matches an attribute information item of the selected phrase to obtain as a prosodic pattern set, the second prosodic patterns being included in the first prosodic patterns. The normalization unit is configured to normalize the second prosodic patterns respectively. The mapping unit is configured to map each of the normalized second prosodic patterns on a low-dimensional space represented by one or more coordinates smaller than the number of the elements to generate mapping coordinates. The display is configured to display the mapping coordinates. The second selection unit is configured to obtain coordinates selected from the mapping coordinates as selected coordinates. The restoring unit is configured to restore a prosodic pattern according to the selected coordinates to obtain a restored prosodic pattern. The replacing unit is configured to replace prosody of synthetic speech generated based on the selected phrase by the restored prosodic pattern.

A prosody editing apparatus, method, and program according to this embodiment will be described hereinafter with reference to the drawings. Note that in the following embodiments, a redundant description will be avoided as needed under the assumption that parts denoted by the same reference numerals perform the same operations.

First Embodiment

A prosody editing apparatus according to the first embodiment will be described below with reference to the block diagram shown in FIG. 1.

A prosody editing apparatus 100 according to the first embodiment includes a speech synthesis unit 101, phrase selection unit 102, prosodic pattern database 103 (to be referred to as a prosodic pattern DB 103 hereinafter), prosodic pattern search unit 104, prosodic model database 105 (to be referred to as a prosodic model DB 105 hereinafter), prosodic pattern generation unit 106, prosodic pattern normalization unit 107, prosodic pattern mapping unit 108, coordinate selection unit 109, prosodic pattern restoring unit 110, prosodic pattern replacing unit 111, and display 112.

The speech synthesis unit 101 externally receives text, generates synthetic speech by applying speech synthesis to the text, and externally outputs the synthetic speech. As the speech synthesis method, concatenative speech synthesis which concatenates phoneme fragments, HMM speech synthesis which creates prosody and voice quality models using a hidden Markov model, and the like are generally known. In this embodiment, any speech synthesis method may be used as long as a prosodic pattern of synthetic speech can be acquired. A prosodic pattern indicates a format of prosody of a phrase, and means time-series changes of parameters such as fundamental frequency, duration, and power which express prosody of a phrase. Also, parameters which express a prosodic pattern have elements not less than the number of phonemes of a phrase.

The phrase selection unit 102 externally receives text, and selects a phrase as a prosody editing range from the text according to a user input, thus obtaining a selected phrase. A selection method of the selected phrase includes, for example, a mouse, keyboard, touch panel, and the like, and a phrase range can be selected using the mouse and the like. The phrase selection unit 102 acquires attribute information of synthetic speech corresponding to the selected phrase from the speech synthesis unit 101. Attribute information includes attributes associated with a phrase such as a surface expression of the phrase, an arrangement order of a phoneme sequence, the number of morae, and an accent type.

The prosodic pattern DB 103 stores attribute information of a phrase and one or more prosodic patterns of the phrase in association with each other. As a registration method of attribute information and prosodic patterns in the prosodic pattern DB 103, for example, general methods may be used. For example, real voice prosodic patterns extracted from recorded speech may be registered, prosodic patterns which have already been edited by the user may be registered, prosodic patterns automatically generated from a prosody statistical model may be registered, and so forth. The prosodic pattern DB 103 may be referred to as a storage.

The prosodic pattern search unit 104 receives the selected phrase and attribute information from the phrase selection unit 102. The prosodic pattern search unit 104 searches the prosodic pattern DB 103 for a phrase, attribute information which matches that of the selected phrase, and obtains one or more prosodic patterns corresponding to the matched phrase as a prosodic pattern set.

The prosodic model DB 105 stores a statistical model. The statistical model indicates a decision tree model or hidden Markov model, which has learned using a speech corpus. When statistical models of a variety of utterance styles, emotions, and speakers are prepared, a variety of prosodic patterns can be generated in correspondence with the selected phrase designated by the user.

The prosodic pattern generation unit 106 receives the selected phrase and prosodic pattern set from the prosodic pattern search unit 104. The prosodic pattern generation unit 106 generates prosodic patterns associated with the selected phrase using the prosodic model DB 105, and adds the generated prosodic patterns to the prosodic pattern set.

Note that when the number of prosodic patterns included in the prosodic pattern set retrieved by the prosodic pattern search unit 104 is not less than a threshold, the prosodic pattern generation unit 106 need not generate a new prosodic pattern.

The prosodic pattern normalization unit 107 receives the prosodic pattern set from the prosodic pattern search unit 104. Note that when the prosodic pattern is added to the prosodic pattern set by the prosodic pattern generation unit 106, the prosodic pattern normalization unit 107 receives the prosodic pattern set from the prosodic pattern generation unit 106. The prosodic pattern normalization unit 107 normalizes respective prosodic patterns of the generated prosodic pattern set.

The prosodic pattern mapping unit 108 receives the normalized prosodic patterns from the prosodic pattern normalization unit 107, maps the normalized prosodic patterns on a low-dimensional space expressed by coordinates smaller than the number of elements of the parameters, and obtains mapping coordinates for respective prosodic patterns.

The coordinate selection unit 109 selects coordinates according to a user instruction, and obtains selected coordinates.

The prosodic pattern restoring unit 110 receives the mapping coordinates from the prosodic pattern mapping unit 108 and the selected coordinates from the coordinate selection unit 109, respectively. The prosodic pattern restoring unit 110 compares the mapping coordinates and selected coordinates to restore a prosodic pattern of coordinates corresponding to the selected coordinates, thus obtaining a restored prosodic pattern.

The prosodic pattern replacing unit 111 receives the restored prosodic pattern from the prosodic pattern restoring unit 110, and replaces a default prosodic pattern generated by the speech synthesis unit 101 by the restored prosodic pattern.

The display 112 receives a prosodic pattern from the speech synthesis unit 101, and displays the received prosodic pattern. Also, the display 112 receives the mapping coordinates from the prosodic pattern mapping unit 108, and displays the received mapping coordinates.

Note that this embodiment assumes the case in which the prosody editing apparatus 100 includes the speech synthesis unit 101. Alternatively, the prosody editing apparatus 100 may not include the speech synthesis unit 101, and may use an external speech synthesis. In this case, the prosodic pattern replacing unit 111 may output the restored prosodic pattern corresponding to the selected phrase to the external speech synthesis device.

An example of attribute information of phrases stored in the prosodic pattern DB 103 will be described below with reference to FIG. 2.

As shown in FIG. 2, the prosodic pattern DB 103 stores an identifier 201 (to be referred to as an ID 201 hereinafter), surface expression 202, phoneme sequence 203, and mora count and accent type 204. A group of the identifier 201, the surface expression 202, the phoneme sequence 203 and the mora count and accent type 204 is referred to as attribute information 205. The prosodic pattern DB 103 also stores a pattern count 206 of prosodic patterns according to each phrase in association with the attribute information 205.

The ID 201 indicates an identification number of a phrase. The surface expression 202 indicates a character string of a phrase. The phoneme sequence 203 indicates a character string of phonemes corresponding to the surface expression 202, and is delimited by "/" for each phoneme group. The mora count and accent type 204 indicate an accent when the surface expression 202 is uttered. The pattern count 206 indicates the number of prosodic patterns of the phoneme sequence 203. More specifically, for example, the ID 201 "1", surface expression 202 "下さい", phoneme sequence 203 "/K/U/D/A/S/A/I/", mora count and accent type 204 "4 moras/type 3", and pattern count 206 "182" are stored in association with each other.

Note that when a language is English, the ID 201, surface expression 202, and phoneme sequence 203 are associated with each other as the attribute information 205, and the pattern count 206 of prosodic patterns is associated with the attribute information 205. More specifically, in the example of FIG. 2, the ID 201 "14", surface expression 202 "Please", phoneme sequence 203 "/p/l/ii/z/", and pattern count 206 "7" are associated with each other. Since English does not include any mora count and accent type unique to Japanese, they are omitted.

An example of prosodic patterns stored in the prosodic pattern DB 103 will be described below with reference to FIG. 3.

For one ID 201 shown in FIG. 2, the ID 201, a PID 301, fundamental frequency 302, and duration 303 are stored for each prosodic pattern in association with each other. The PID 301 indicates an identifier used to identify each of patterns corresponding to one ID 201. The fundamental frequency 302 indicates pitches of tones of a phoneme. In this embodiment, a frequency per frame is stored as each element. The duration 303 is a time length of voice production of a phoneme. In this embodiment, the duration 303 indicates how many frames one phoneme continues, and the number of frames per phoneme is stored as each element.

For example, a phrase "いかがですか (IKAGADESUKA)" of the ID 201 "9" in FIG. 2 has 41 prosodic patterns, and FIG. 3 shows four out of the 41 patterns. For example, the PID 301 "1", fundamental frequency 302 "[284, 278, 273, 266, 261, 259, 255, . . . ]", and duration 303 "[12, 12, 11, 7, 9, 9, 9, 18, 12, 23]" are stored in association with each other. That is, as can be seen from FIG. 3, a phoneme "I" of the phrase "いかがですか (IKAGADESUKA)" has a 12-frame length, and fundamental frequencies "284, 278, 273, 266, 261, 259, 255, . . . " continue for respective frames.

As the aforementioned patterns, patterns varied to the extent possible are desirably prepared. For example, when prosodic patterns of various kinds of paralinguistic information, emotions, styles, and speakers can be prepared, the user can select a desired pattern from a variety of prosodic patterns. Note that in the example of FIG. 3, the parameters include the fundamental frequency and duration. Furthermore, power indicating tone volumes when phonemes are uttered may be stored as a parameter in association with the aforementioned parameters.

The relationship among the fundamental frequency, duration, and power in a prosodic pattern will be described below with reference to FIG. 4.

Figure 4:
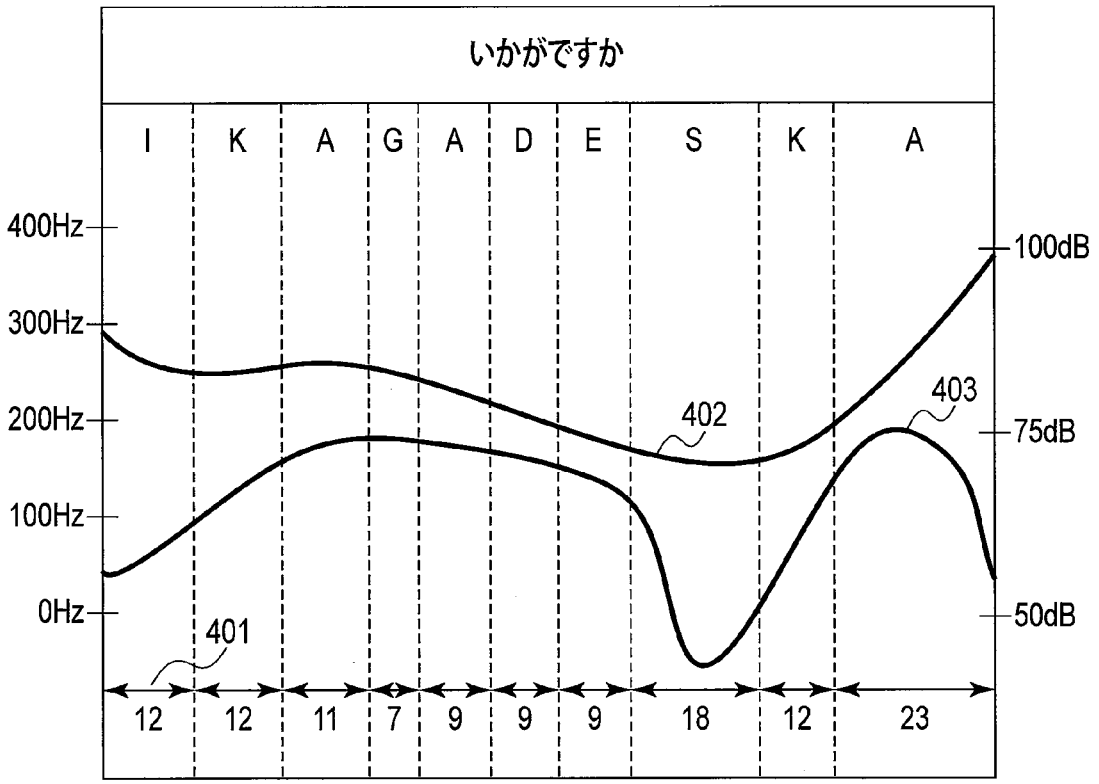
FIG. 4 is a graph illustrating the relation among fundamental frequency, duration, and power.

FIG. 4 shows a graph generated based on fundamental frequency, duration, and power as parameters of the prosodic pattern of the phrase "いかがですか いかがですか". The horizontal axis represents a time (unit: frames), the left side of the vertical axis represents a frequency (unit: Hz), and the right side the vertical axis represents power (unit: dB). Note that other units may be used (for example, "sec" for a time unit, and "octave" for a frequency unit).

The duration can be expressed as time-series data of respective phoneme widths 401. For example, a phoneme "/I/" is expressed by 12 frames, a phoneme "/K/" is expressed by 12 frames, and a phoneme "/A/" is expressed by 11 frames. Data obtained by arranging these phoneme widths along a time series are elements stored in the duration 303 shown in FIG. 3.

One frequency value corresponds to each frame on this coordinate space, and the fundamental frequencies can be expressed as one contour 402 which connects the frequency values. In this case, assume that a frequency value is set for each frame. However, the frequency value may be set for various other units (for each phoneme, for each vowel, and the like). Data obtained by arranging these frequency values in turn along a time series are elements stored in the fundamental frequency 302 shown in FIG. 3.

The power can be expressed as one contour 403 which connects power values for respective frames in the same manner as the contour 402 of the fundamental frequency.

Figure 5:
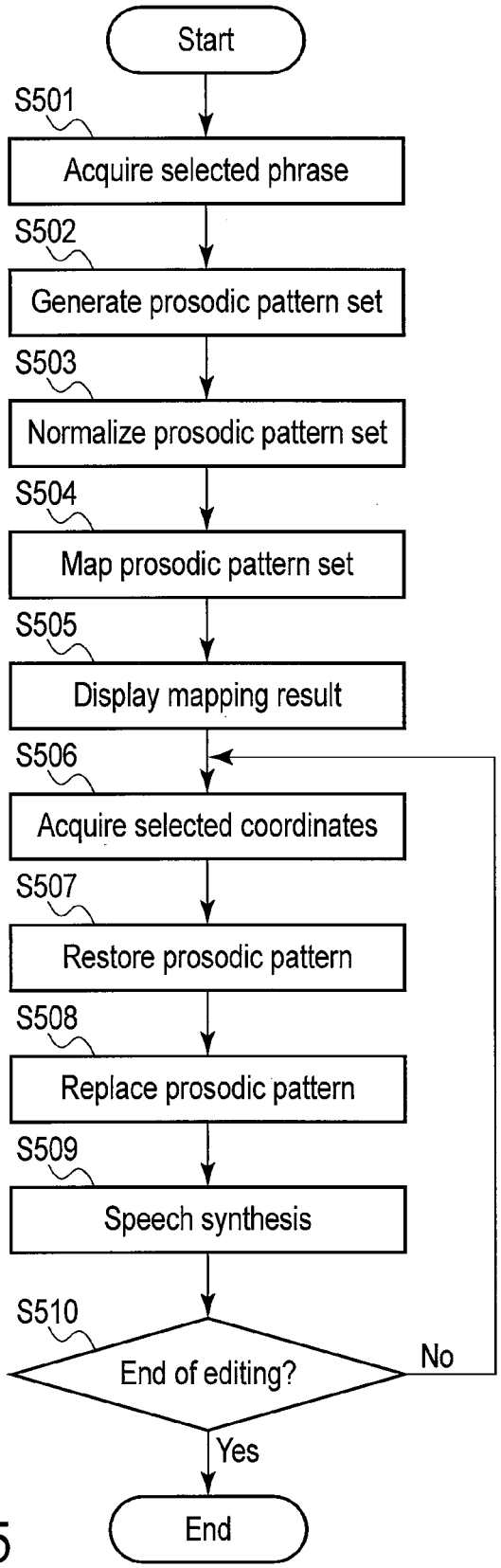
FIG. 5 is a flowchart illustrating the operation of a prosody editing apparatus.

The operation of the prosody editing apparatus according to this embodiment will be described below with reference to the flowchart shown in FIG. 5.

In step S501, the prosodic pattern search unit 104 receives a selected phrase from the user.

In step S502, the prosodic pattern search unit 104 searches the prosodic pattern DB 103 for a phrase, the attribute information of which matches that of the selected phrase, and obtains prosodic patterns corresponding to the phrase matching the attribute information, as a prosodic pattern set. As a search method, using a surface expression as attribute information of the phrase, whether or not a phrase having a surface expression which matches that of the selected phrase may be searched. Alternatively, using a phoneme sequence as attribute information, whether or not a phrase having a phoneme sequence which matches that of the selected phrase may be searched. Furthermore, using a mora count and accent type as attribute information, whether or not a phrase having a mora count and accent type which match those of the selected phrase may be searched.

Since prosodic patterns of phrases having the same mora count and accent type are normally similar to each other, even when the number of prosodic patterns of a phrase which match a surface expression is small, prosodic patterns, a surface expression of which differs but match for a mora count and accent type are used as a prosodic pattern set, thus increasing variations of prosodic patterns.

Note that the prosodic pattern generation unit 106 may generate prosodic patterns of the selected phrase using the statistical models stored in the prosodic model DB 105. Using the statistical models stored in the prosodic model DB 105, even when the selected phrase has attributes which do not match those of prosodic patterns stored in the prosodic pattern DB 103, prosodic patterns can be generated.

In step S503, the prosodic pattern normalization unit 107 respectively normalizes prosodic patterns included in the prosodic pattern set. The normalization processing will be described later with reference to FIG. 6.

In step S504, the prosodic pattern mapping unit 108 maps the normalized prosodic patterns of the prosodic pattern set on a low-dimensional space. The mapping processing onto the low-dimensional space can use, for example, principal component analysis. The practical mapping processing will be described later with reference to FIGS. 7 and 8.

In step S505, the display 112 displays mapping coordinates of the mapped prosodic pattern set.

In step S506, the coordinate selection unit 109 obtains coordinates of a region selected by the user as selected coordinates.

In step S507, the prosodic pattern restoring unit 110 restores the selected prosodic pattern, thus generating a restored prosodic pattern. The practical restoring processing will be described later.

In step S508, the prosodic pattern replacing unit 111 replaces the prosodic pattern of the selected phrase by the restored prosodic pattern. In this case, when simple replacing processing is done, since prosody cannot be smoothly connected before and after the phrase, synthetic speech may often become unnatural. In this case, a general method may be used to, for example, correct the fundamental frequency contour.

In step S509, the speech synthesis unit 101 executes speech synthesis using the restored prosodic pattern.

It is determined in step S510 whether or not the restored prosodic pattern is a prosodic pattern of synthetic speech desired by the user. If it is determined that the restored prosodic pattern is the prosodic pattern of synthetic speech desired by the user, processing ends. Whether or not the restored prosodic pattern is the prosodic pattern of synthetic speech desired by the user can be determined by seeing, for example, if the user selects an OK button displayed on the display 112. On the other hand, if it is determined that the restored prosodic pattern is not a prosodic pattern of synthetic speech desired by the user, the process returns to step S506, and the user selects another prosodic pattern from the mapping coordinates displayed on the display 112. In this manner, the operation of the prosody editing apparatus 100 according to this embodiment ends.

The normalization processing in the prosodic pattern normalization unit 107 will be described below with reference to FIG. 6.

Figure 6:
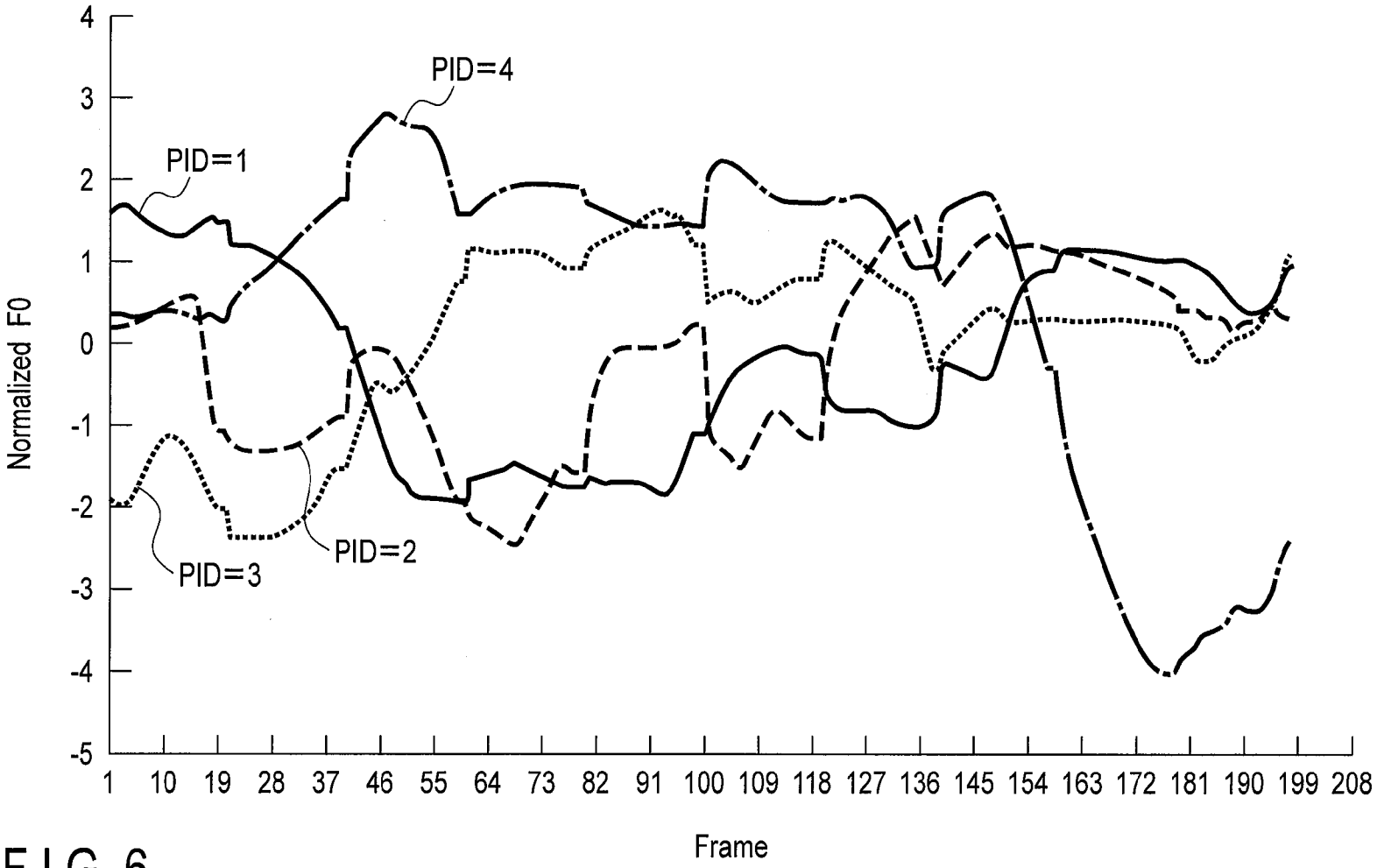
FIG. 6 is a graph illustrating normalization processing in a prosodic pattern normalization unit.

FIG. 6 shows a normalization example of four prosodic patterns (PID=1, 2, 3, and 4) of the phrase "いかがですか" shown in FIG. 3. The vertical axis is a normalized value when an average value of fundamental frequencies is zero, and the horizontal axis is the number of frames. In this case, the numbers of frames of the prosodic patterns are adjusted to 200 frames. That is, the number of elements of each prosodic pattern is 200 (200-dimensional data).

In general, fundamental frequencies have different average values, i.e., different voice pitches, according to person. For this reason, an average value of fundamental frequencies is adjusted to be zero, and the average value is adjusted using fundamental frequencies of a target speaker upon restoring a prosodic pattern. Also, since data lengths of fundamental frequencies differ according to prosodic patterns, each data length is linearly compressed to be an arbitrary fixed length set for each phoneme to adjust the data lengths of other prosodic patterns. Finally, the fundamental frequencies and frames of duration are normalized to have an average=0 and a standard deviation=1. With these processes, units of fundamental frequencies and duration can be adjusted. Note that original average and standard deviation data used in normalization are held to be able to restore original values.

The mapping processing of the prosodic pattern mapping unit 108 will be described below with reference to FIGS. 7 and 8.

This embodiment will exemplify mapping of the prosodic pattern set on the low-dimensional space using principal component analysis. Note that it is desirable to map prosodic patterns on a coordinate space of three dimensions or less as the low-dimensional space. However, the low-dimensional space is not limited to a two-dimensional coordinate plane as long as a coordinate plane can display a prosodic pattern using coordinates smaller than the number of elements of the parameters.

As shown in FIG. 7, upon execution of the mapping, a matrix X 703 is generated first by coupling elements 701 of fundamental frequencies and elements 702 of duration of the normalized prosodic pattern set. Each row of the matrix X corresponds to elements obtained by coupling fundamental frequencies and duration of each prosodic pattern. By generating the matrix in this way, the fundamental frequencies and duration can be edited at the same time.

Figure 8:
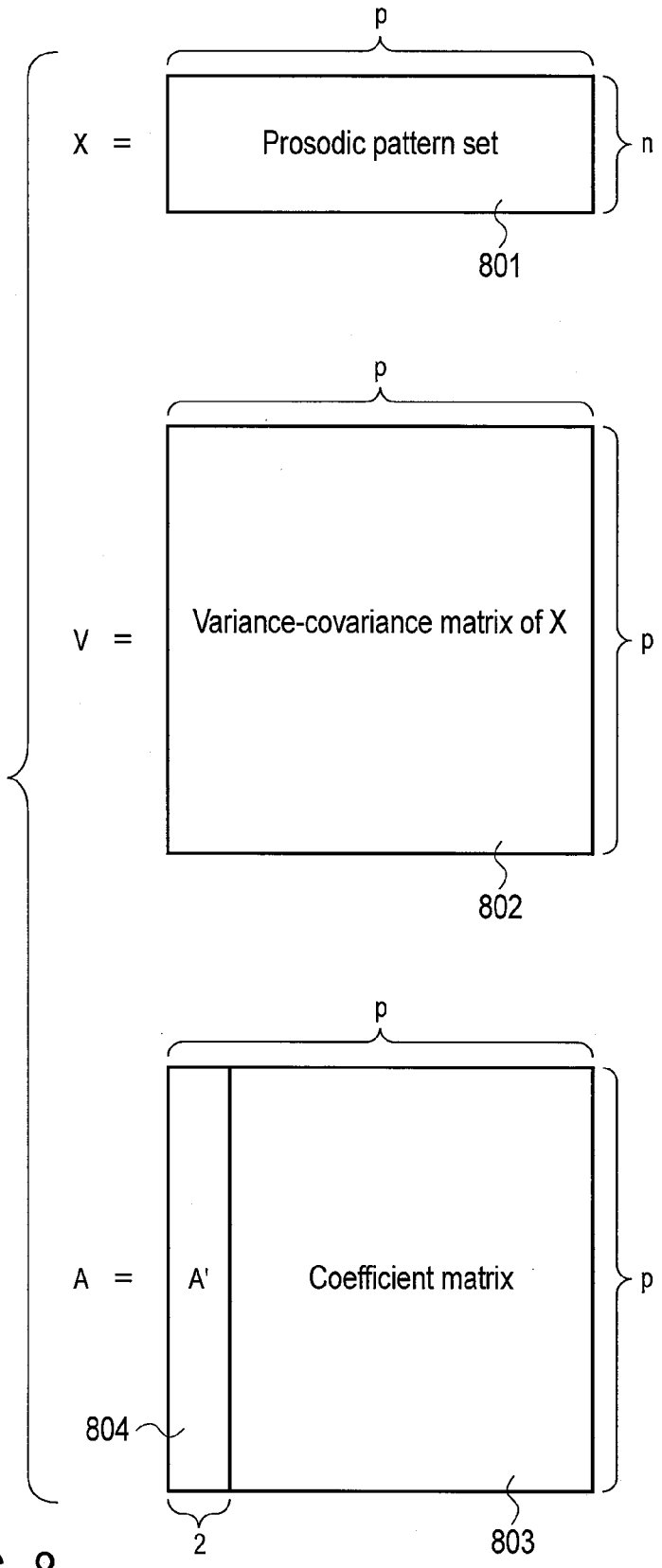
FIG. 8 is a view for explaining the mapping processing of the prosodic pattern mapping unit.

FIG. 8 shows a matrix size of the matrix X of the prosodic pattern set.

A matrix X 801 of the prosodic pattern set is defined by n rows×p columns, as simply shown in FIG. 8. With respect to this matrix X 801 of n rows×p columns, a variance-covariance matrix V 802 of the matrix X 801 is calculated using:

$$V = \frac{1}{n} X^T X \tag{1}$$

where $X^T$ means a transposed matrix of X. This variance-covariance matrix V 802 has a size of p rows×p columns. Next, eigenvalues and eigenvectors of the variance-covariance matrix V 802 are calculated to obtain p eigenvectors (column vectors) corresponding to p eigenvalues. A coefficient matrix A 803 is generated by arranging eigenvectors in descending order of eigenvalue, and a matrix A' 804 is generated by extracting first two columns (up to second principal components) of the coefficient matrix A 803. That is, the matrix A' 804 has a matrix size of p rows×2 columns.

Next, each prosodic pattern of the prosodic pattern set is converted into two-dimensional coordinates using:

$$Z = XA' \tag{2}$$

A matrix Z has a size of n rows×2 columns. That is, each row of the matrix Z is used as data obtained by converting each prosodic pattern into two-dimensional coordinates, which are used as mapping coordinates.

An example of mapping coordinates displayed on the display 112 will be described below with reference to FIG. 9.

Figure 9:
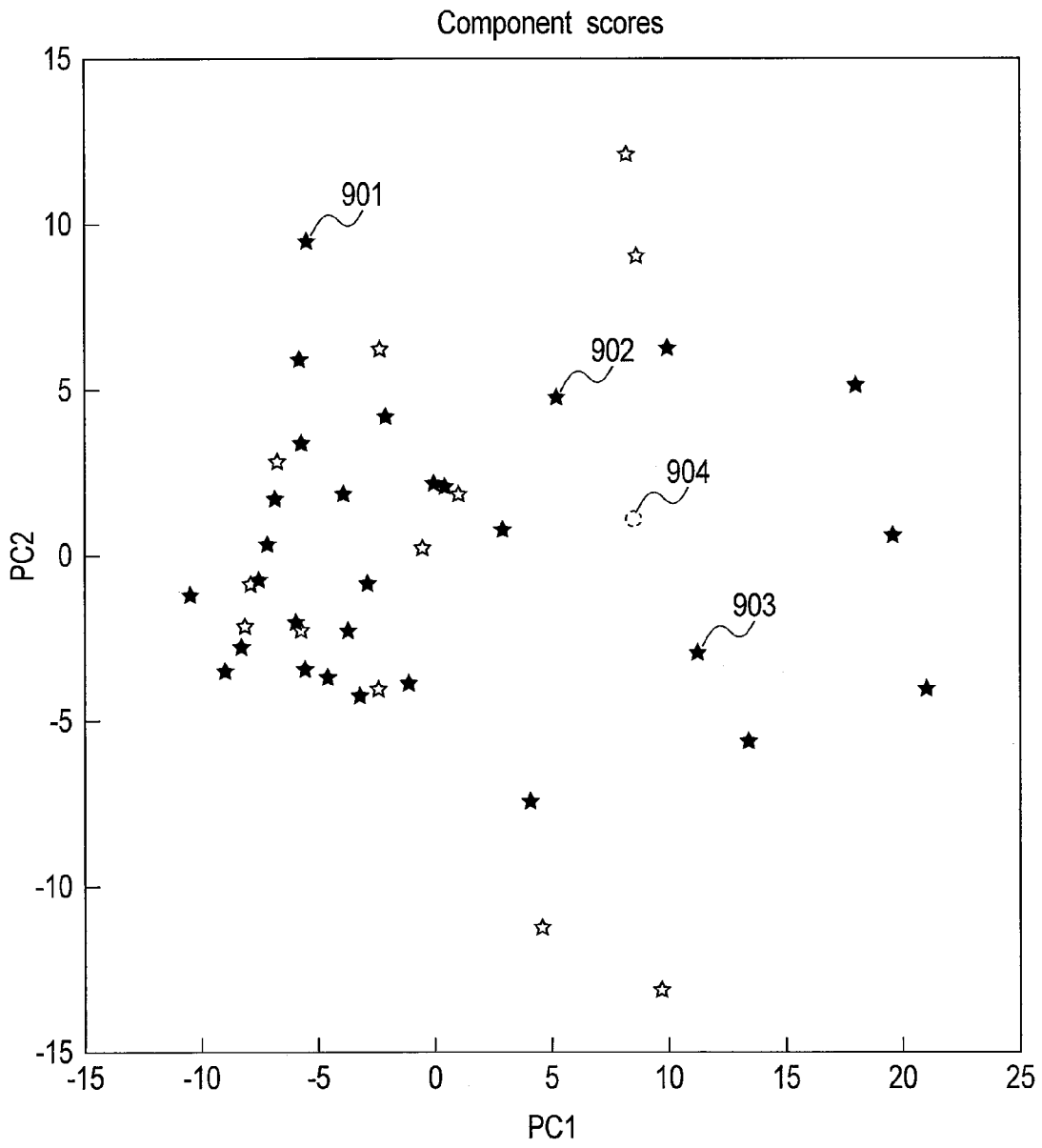
FIG. 9 is a view illustrating an example of mapping coordinates displayed on a display.

FIG. 9 shows a display example of prosodic patterns mapped on a two-dimensional coordinate plane. In FIG. 9, mapping coordinates 901, 902, and 903 of prosodic patterns are respectively expressed by stars. Note that a display range of the two-dimensional coordinate plane is clipped to a range including prosodic patterns to have a first coordinate axis (from −15 to 25) and second coordinate axis (from −15 to 15). With this clipping, even when the user selects an arbitrary point on the two-dimensional coordinate plane, improper prosody which is largely different from a prosodic pattern registered in the prosodic pattern DB 103 can be prevented from being generated.

The restored prosodic pattern generation processing in the prosodic pattern restoring unit 110 will be described below.

Assuming that the user selects coordinates z from the two-dimensional coordinate plane shown in FIG. 9, the prosodic pattern restoring unit 110 restores the selected coordinates z to a restored prosodic pattern x using:

$$x = zA'^{T} \quad (3)$$

Note that since the restored prosodic pattern x is normalized, a restored prosodic pattern is obtained by respectively restoring fundamental frequencies to a unit of Hz and duration to a unit of frames using the saved average and standard deviation data.

Note that the user can select not only coordinates, a point of which is displayed, but also arbitrary coordinates. For example, when the user selects a point 904 indicated by a wavy circle in FIG. 9, a restored prosodic pattern x can be obtained by substituting the coordinates of the point 904 into equation (3) above. The restored prosodic pattern in this case has intermediate features between prosodic patterns 902 and 903 since the point 904 is located at an intermediate position between the prosodic patterns 902 and 903. That is, since a prosodic pattern which is not stored in the prosodic pattern DB 103 can be generated, fine adjustment of a prosodic pattern is allowed, thus improving the degree of freedom in editing.

An example of the user interface displayed on the display 112 will be described below with reference to FIG. 10.

Figure 10A:
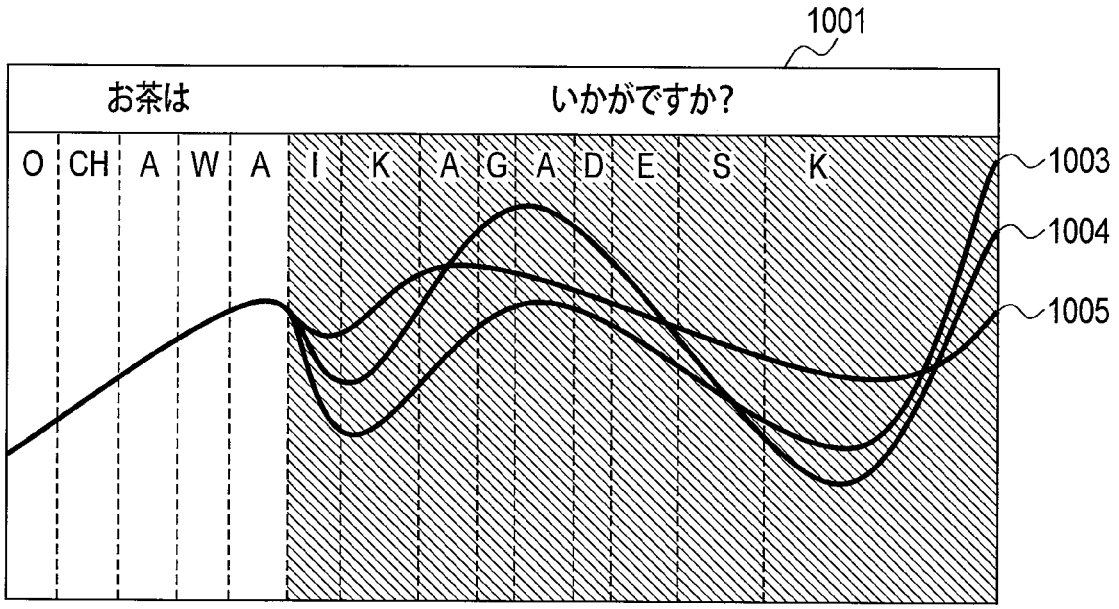
FIG. 10A is a graph illustrating prosodic patterns.
Figure 10B:
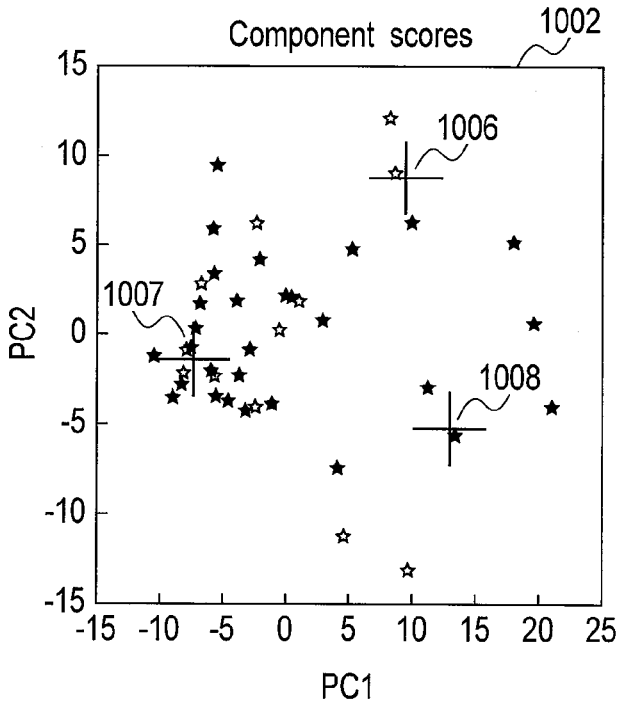
FIG. 10B shows a two-dimensional coordinate plane on a user interface displayed on the display.

FIG. 10 shows a prosody edit screen, that is, (a) of FIG. 10 shows a prosodic pattern parameter graph 1001, and (b) of FIG. 10 shows a two-dimensional coordinate plane 1002. As a use example, the following method is available. That is, when the user selects a character string "いかがですか" so as to edit prosody of a phrase "いかがですか", the prosody editing apparatus executes the aforementioned processing, and displays the parameter graph 1001 and two-dimensional coordinate plane 1002 on the display 112.

The parameter graph shows contours 1003, 1004, and 1005 of prosodic patterns of the phrase "いかがですか". The contour 1003 of the prosodic pattern is displayed when a cursor is located at a position of coordinates 1006 on the two-dimensional coordinate plane 1002. Likewise, the contours 1004 and 1005 of the remaining prosodic patterns are displayed when the cursor is located respectively at positions of coordinates 1007 and 1008.

The user can recognize various changes of prosodic patterns in real time by moving the cursor on the two-dimensional coordinate plane 1002. Also, the user can reproduce synthetic speech to which a target prosodic pattern is applied by designating coordinates on the two-dimensional coordinate plane 1002 using a pointing device such as a mouse or touching coordinates on the screen with the finger or the like. Hence, the user can audibly confirm the selected prosodic pattern as desired.

Also, since the aforementioned mapping processing maps similar prosodic patterns to be located at close positions and non-similar prosodic patterns to be located at distant positions, the user can visually recognize different prosodic patterns, and can easily try different prosodic patterns.

Note that the prosody editing apparatus may present only phrases, which are stored in the prosodic pattern DB 103 and can be edited, to the user first, and may prompt the user to select a phrase from the presented phrases, so as to obtain a selected phrase.

According to the first embodiment described above, prosodic patterns of a phrase having attribute information, which matches that of a selected phrase selected by the user, are searched for, and a plurality of prosodic patterns are mapped on the low-dimensional space such as the two-dimensional coordinate plane. Thus, the user can easily obtain a desired prosodic pattern by designating only coordinates. Also, by limiting prosodic patterns, which can be selected by the user, onto the two-dimensional coordinate plane, a prosodic pattern which is not assumed normally can be suppressed from being generated, thus allowing efficient editing of prosody.

First Modification of the First Embodiment

In the first embodiment, one matrix is generated by coupling normalized fundamental frequencies and duration, and is mapped on the two-dimensional coordinate plane using principal component analysis. However, in the first modification, matrices of fundamental frequencies and duration are mapped on the two-dimensional coordinate plane respectively.

Mapping processing of the prosodic pattern mapping unit 108 according to the first modification will be described below with reference to FIG. 11.

Figure 11A:
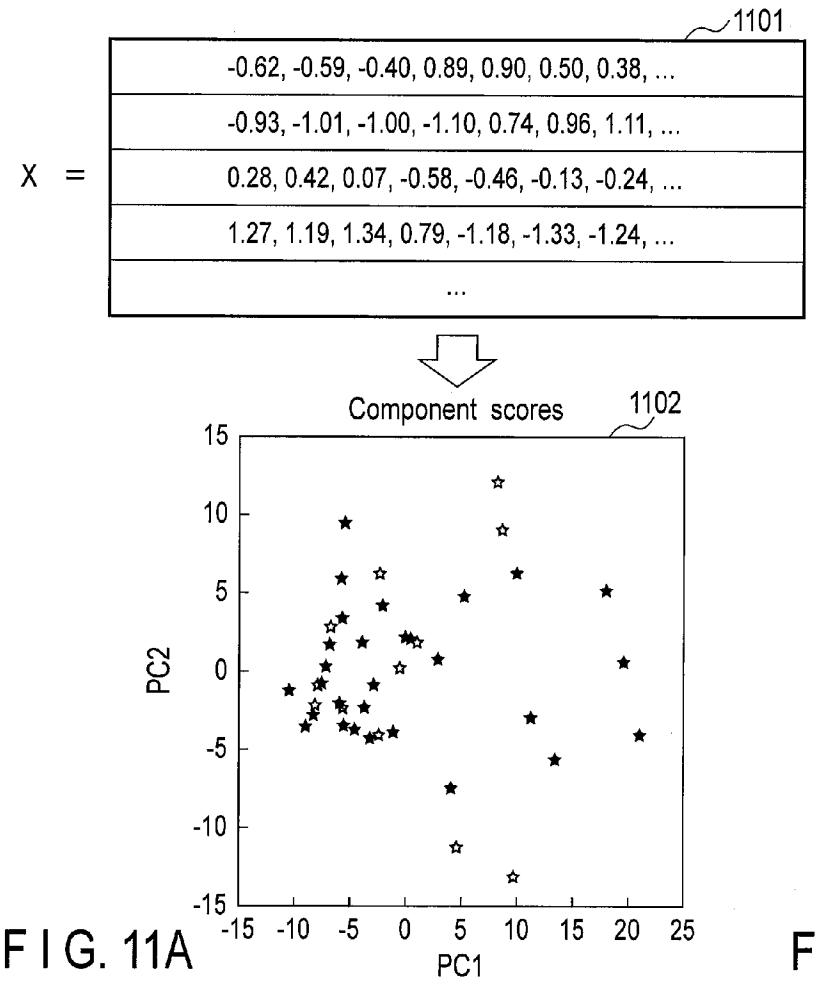
FIG. 11A shows a normalized fundamental frequency matrix and a corresponding two-dimensional coordinate plane.
Figure 11B:
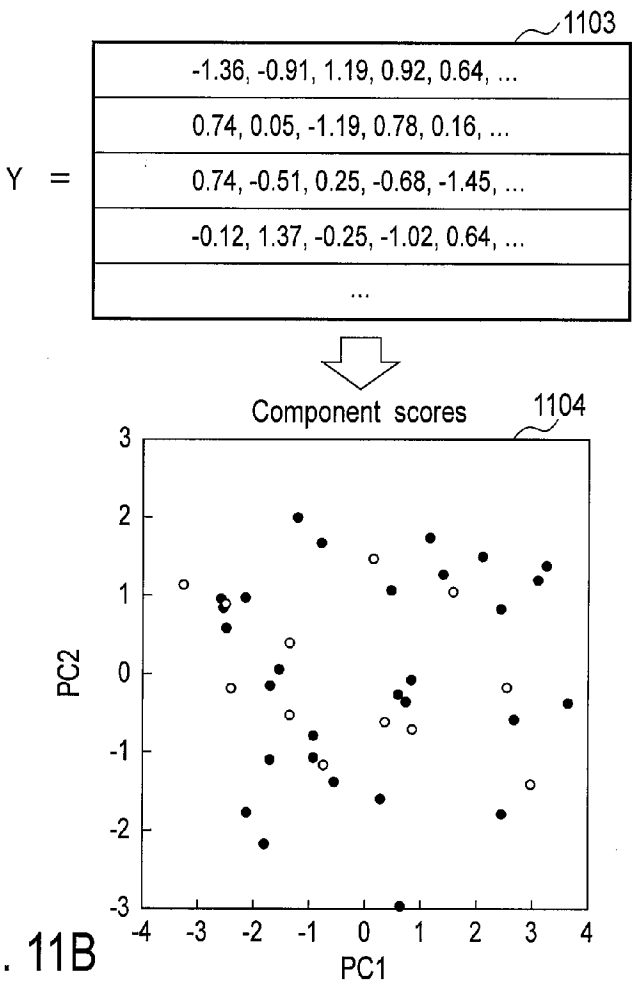
FIG. 11B shows a normalized duration matrix and a corresponding two-dimensional coordinate plane.

(a) of FIG. 11 shows a normalized fundamental frequency matrix 1101 and a corresponding two-dimensional coordinate plane 1102, and (b) of FIG. 11 shows a normalized duration matrix 1103 and a corresponding two-dimensional coordinate plane 1104.

As shown in (a) and (b) of FIG. 11, the prosodic pattern mapping unit 108 independently applies principal component analysis to fundamental frequencies and duration to map them on the two-dimensional coordinate planes as a low-dimensional space. Since the principal component analysis method can use the aforementioned method, a description thereof will not be given.

An example of an interface according to the first modification will be described below with reference to FIG. 12.

Figure 12:
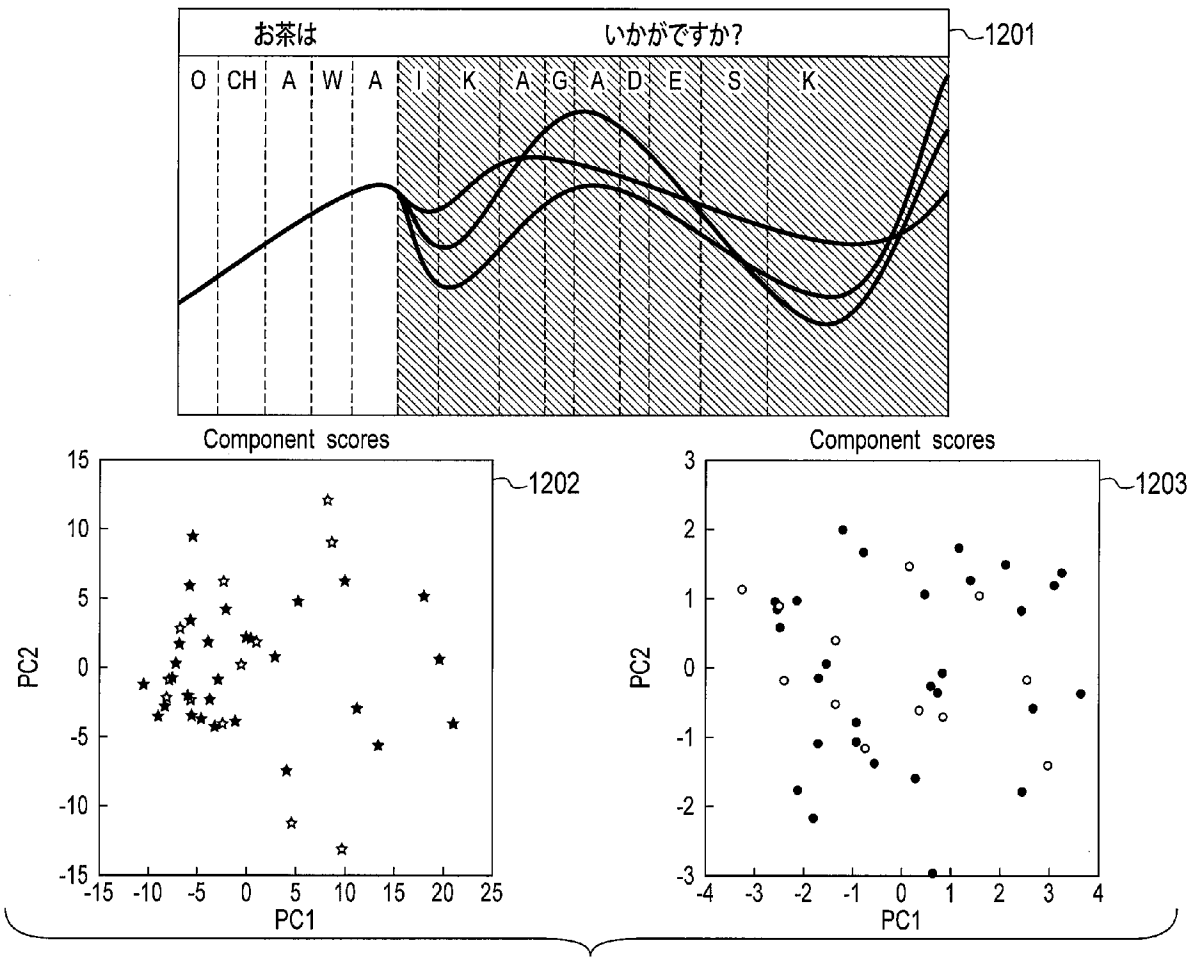
FIG. 12 is a view illustrating an example of an interface according to the first modification.

As shown in FIG. 12, the display 112 displays a prosody editing screen 1201, fundamental frequency two-dimensional coordinate plane 1202, and duration two-dimensional coordinate plane 1203.

The user can edit a prosodic pattern by moving a cursor on the two-dimensional coordinate plane 1202 or 1203 by the same method as in the first embodiment.

According to the first modification described above, the number of parameters to be controlled is increased, and the parameters are independently controlled, thus increasing a degree of freedom in prosody editing, and allowing generation of a more detailed prosodic pattern.

Second Modification of the First Embodiment

In this embodiment, prosodic patterns are displayed as points on the two-dimensional coordinate plane. However, as the number of prosodic patterns becomes larger, the number of points increases, and the user cannot visually confirm them. Hence, in the second modification, some points are clustered, and a representative point is displayed. Thus, the user can easily discriminate prosodic pattern groups from each other.

A display example of a two-dimensional coordinate plane after clustering according to the second modification will be described below with reference to FIG. 13.

Figure 13:
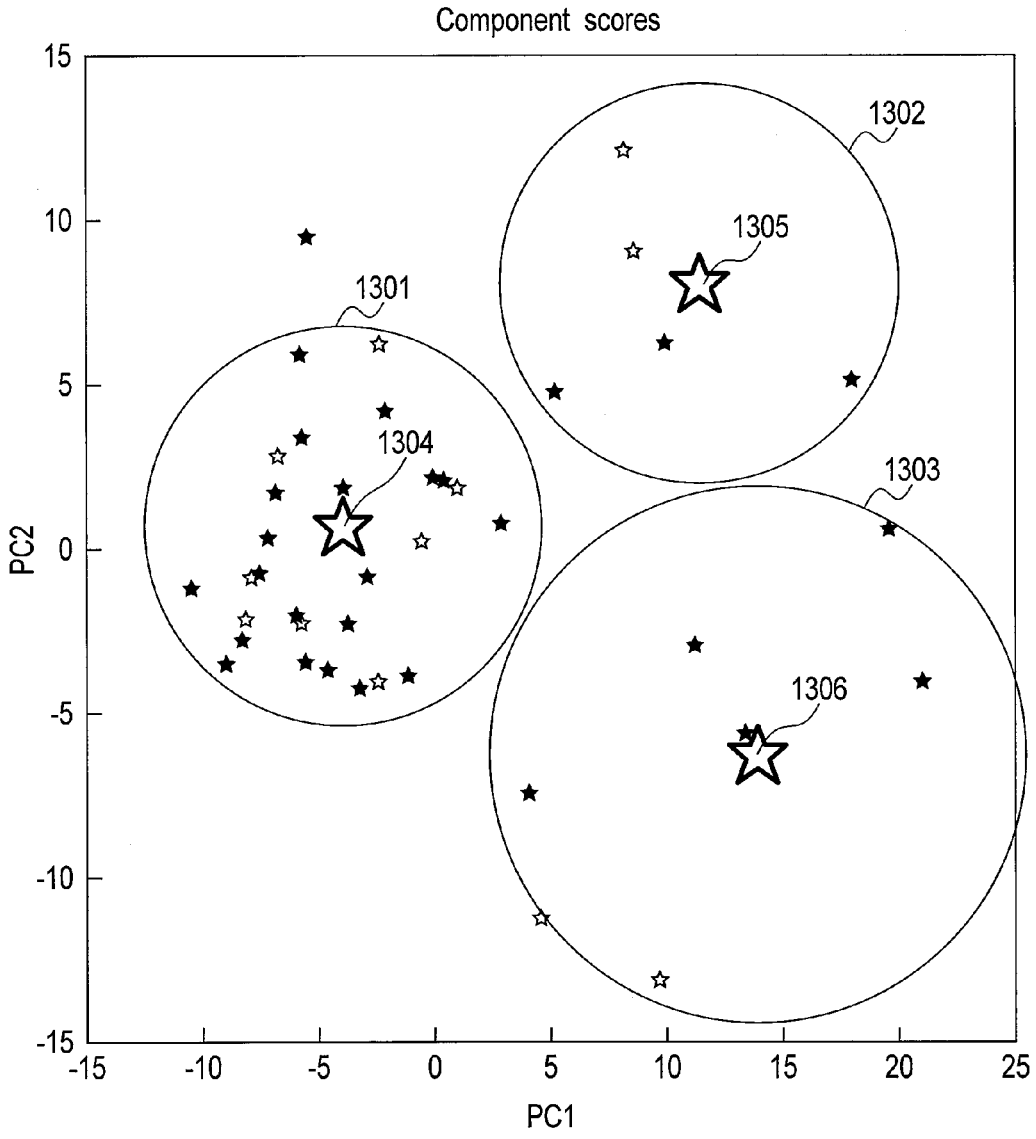
FIG. 13 is a view illustrating a display example of a two-dimensional coordinate plane after clustering according to the second modification.

FIG. 13 shows prosodic patterns mapped on a two-dimensional coordinate plane. Clusters 1301, 1302, and 1303 are displayed, and representative points 1304, 1305, and 1306 of these clusters are also displayed.

The prosodic pattern mapping unit 108 generates a cluster which combines one or more prosodic patterns by clustering prosodic patterns. Since the clustering can use a general method, a description thereof will not be given. The representative point can be set as a central point of the cluster (that of a circle in FIG. 13), but a setting method is not particularly limited as long as a representative point which expresses a feature of a cluster can be set. Note that in FIG. 13, points of prosodic patterns and the representative points of the clusters are displayed at the same time, but only the representative points of the clusters may be displayed.

According to the second modification described above, prosodic pattern groups can be easily discriminated from each other by clustering prosodic patterns.

Third Modification of the First Embodiment

In the third modification, in addition to the fundamental frequency 302 and duration 303, which are stored in the prosodic pattern DB 103, a label which expresses a prosodic feature of a prosodic pattern may be stored in association with them.

FIG. 14 shows an example of prosodic patterns stored in the prosodic pattern DB 103 according to the third modification.

As shown in FIG. 14, the prosodic pattern DB 103 stores the ID 201, the PID 301, the fundamental frequency 302, the duration 303, and a label 1401 in association with each other. The label 1401 includes, for example, classes such as "normal", "question", and "anger".

Figure 15:
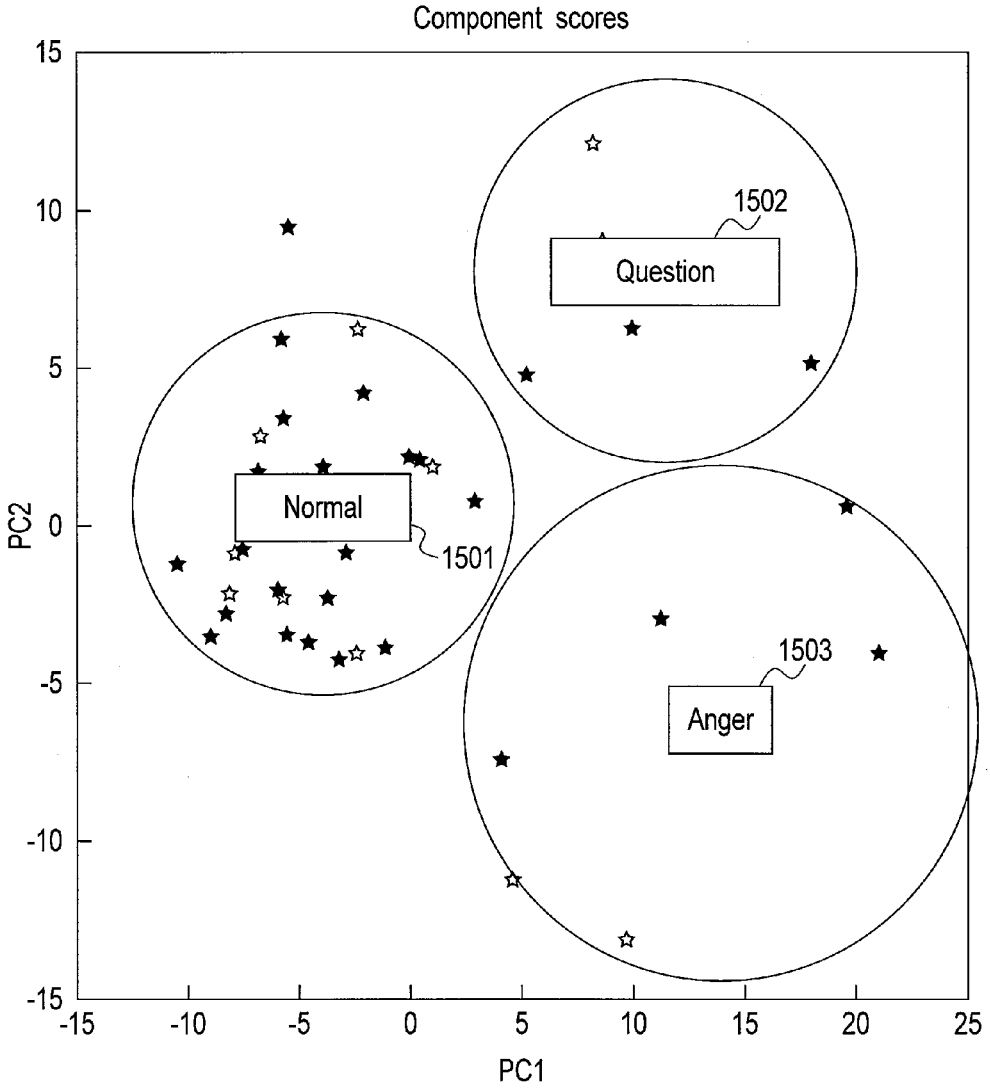
FIG. 15 is a view illustrating a display example of a two-dimensional coordinate plane after clustering according to the third modification.

A display example on a two-dimensional coordinate plane after clustering according to the third modification will be described below with reference to FIG. 15.

When a label is stored in the prosodic pattern DB 103, the prosodic pattern mapping unit 108 tallies classes of labels associated with prosodic patterns in respective clusters after clustering of prosodic patterns, and displays classes of highest frequencies as labels 1501, 1502, and 1503. In this manner, the user can recognize prosodies even when he or she actually listens to synthetic speech.

According to the third modification described above, since labels are assigned to groups obtained by clustering prosodic patterns, prosodies of classes of prosodic pattern groups can be easily distinguished from each other.

Second Embodiment

In the first embodiment, the prosodic pattern restoring unit restores a prosodic pattern by restoring coordinates selected by the user using equation (3). However, processing for mapping prosodic patterns on a two-dimensional coordinate plane by principal component analysis is often irreversible processing, and a prosodic pattern stored in the prosodic pattern DB cannot always be completely restored from coordinates on the two-dimensional coordinate plane.

Hence, in the second embodiment, a prosodic pattern stored in a prosodic pattern DB 103 is applied without executing restoring processing given by equation (3).

Figure 16:
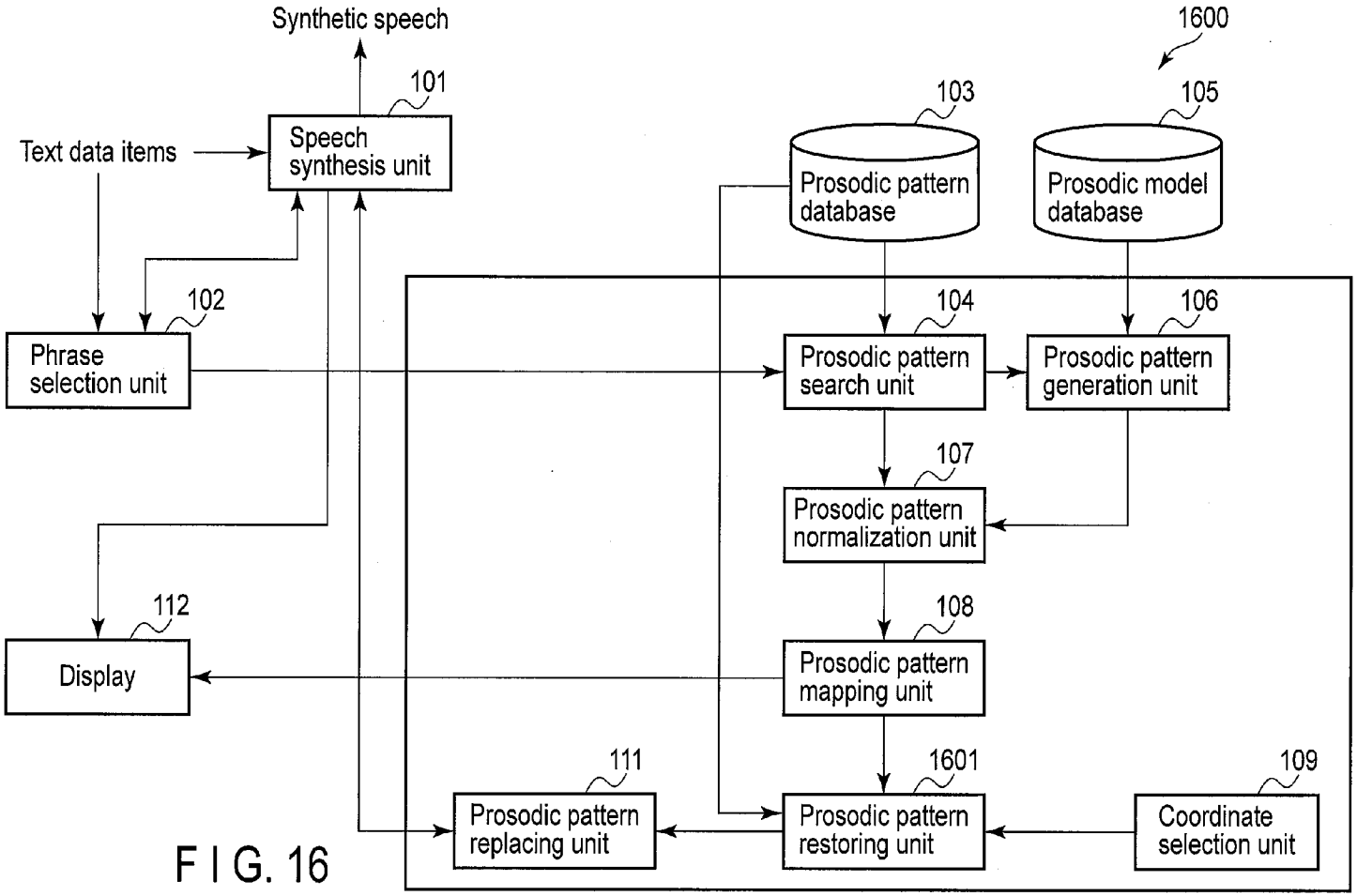
FIG. 16 is a block diagram illustrating a prosody editing apparatus according to the second embodiment.

A prosody editing apparatus according to the second embodiment will be described below with reference to the block diagram shown in FIG. 16.

A prosody editing apparatus 1600 according to the second embodiment includes a speech synthesis unit 101, phrase selection unit 102, prosodic pattern DB 103, prosodic pattern search unit 104, prosodic model DB 105, prosodic pattern generation unit 106, prosodic pattern normalization unit 107, prosodic pattern mapping unit 108, coordinate selection unit 109, prosodic pattern restoring unit 1601, prosodic pattern replacing unit 111, and display 112. Since the units other than the prosodic pattern restoring unit 1601 are the same as those of the prosody editing apparatus 100 according to the first embodiment, a description thereof will not be repeated.

The prosodic pattern restoring unit 1601 receives selected coordinates selected by the user from the coordinate selection unit 109, and mapping coordinates from the prosodic pattern mapping unit 108. The prosodic pattern restoring unit 1601 determines whether or not a plurality of mapping coordinates include mapping coordinates, a distance from the selected coordinates of which is not more than a threshold. If mapping coordinates, a distance of which is not more than the threshold, are found, fundamental frequencies and duration of an original prosodic pattern corresponding the found mapping coordinates are acquired from the prosodic pattern DB 103 as a restored prosodic pattern.

Processing of the prosodic pattern restoring unit 1601 according to the second embodiment will be described below with reference to FIG. 17.

Figure 17:
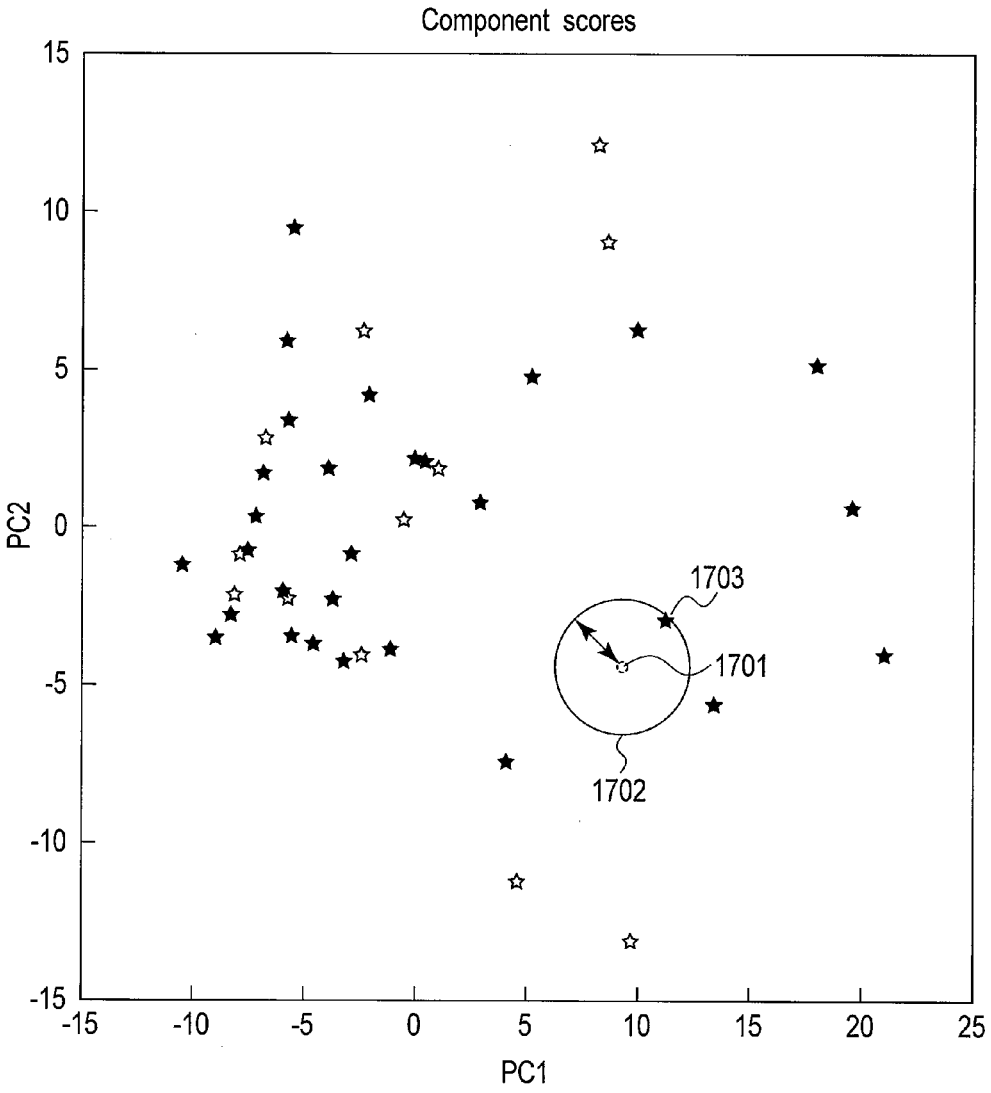
FIG. 17 is a view illustrating processing of a prosodic pattern restoring unit according to the second embodiment.

FIG. 17 shows a two-dimensional coordinate plane displayed on the display 112. Assume that the user selects coordinates 1701, a prosodic pattern point of which is not displayed.

The prosodic pattern restoring unit 1601 determines whether or not mapping coordinates are found within a threshold distance range from the coordinates 1701. As this determination method, whether or not a prosodic pattern point is found within a circle 1702 having a constant distance from the coordinates 1701. In FIG. 17, since a prosodic pattern point 1703 is found within the circle 1702, an original prosodic pattern corresponding to the point 1703 is acquired from the prosodic pattern DB 103. The acquired original prosodic pattern is used in subsequent replacing processing as a restored prosodic pattern.

According to the second embodiment described above, when a prosodic pattern point is found with a threshold distance range from the selected coordinates, a corresponding prosodic pattern is acquired from the database, thus suppressing deterioration of a prosodic pattern, and allowing easy and efficient prosody editing.

Note that the prosody editing apparatus according to the aforementioned embodiments may be implemented by hardware.

Figure 18:
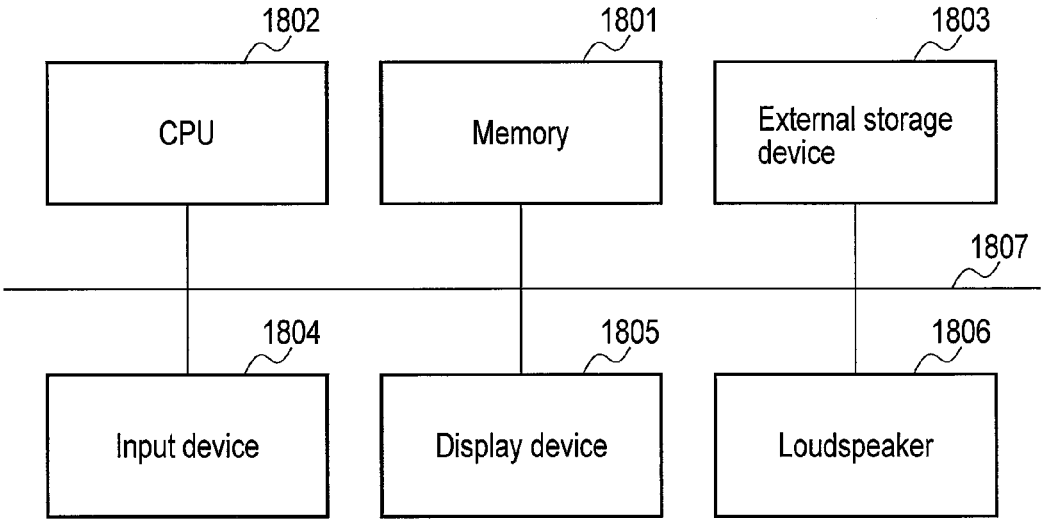
FIG. 18 is a block diagram illustrating the hardware arrangement of a prosody editing apparatus.

FIG. 18 is a block diagram illustrating the hardware arrangement of the prosody editing apparatus according to this embodiment. The prosody editing apparatus includes a memory 1801 which stores a prosody editing program required to execute prosody editing processing, and the like, a CPU 1802 which controls respective units of the prosody editing apparatus according to the program in the memory 1801, an external storage device 1803 which stores various data required for the control of the prosody editing apparatus, an input device 1804 which accepts inputs from the user, a display device 1805 which displays a user interface such as results of the prosody editing processing, a loudspeaker 1806 which outputs synthetic speech and the like, and a bus 1807 which connects the respective units. Note that the external storage device 1803 may be connected to the respective units via a wired or wireless LAN (Local Area Network) or the like.

The flowcharts of the embodiments illustrate methods and systems according to the embodiments. It will be understood that each block of the flowchart illustrations, and combinations of blocks in the flowchart illustrations, can be implemented by computer program instructions. These computer program instructions may be loaded onto a computer or other programmable apparatus to produce a machine, such that the instructions which execute on the computer or other programmable apparatus create means for implementing the functions specified in the flowchart block or blocks. These computer program instructions may also be stored in a computer-readable memory that can direct a computer or other programmable apparatus to function in a particular manner, such that the instruction stored in the computer-readable memory produce an article of manufacture including instruction means which implement the function specified in the flowchart block or blocks. The computer program instructions may also be loaded onto a computer or other programmable apparatus to cause a series of operational steps to be performed on the computer or other programmable apparatus to produce a computer programmable apparatus which provides steps for implementing the functions specified in the flowchart block or blocks.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A prosody editing apparatus comprising:

a storage configured to store attribute information items of phrases and one or more first prosodic patterns corresponding to each of the attribute information items of the phrases;

a search unit configured to search the storage for one or more second prosodic patterns corresponding to an attribute information item that matches an attribute information item of a predetermined phrase, the second prosodic patterns being included in the first prosodic patterns;

a mapping unit configured to map each of the second prosodic patterns on a low dimensional space to generate mapping coordinates, the mapping coordinates being used to suppress a first prosodic pattern which is not assumed normally, wherein a first distance between coordinates of the first prosodic pattern and coordinates of a target prosodic pattern is not within a first threshold;

a selection unit configured to obtain coordinates selected from the mapping coordinates as selected coordinates;

a restoring unit configured to restore a second prosodic pattern according to the selected coordinates to obtain a restored prosodic pattern; and a replacing unit configured to replace prosody of synthetic speech generated based on the predetermined phrase by the restored prosodic pattern.

2. The apparatus of claim 1, further comprising a generation unit configured to generate a third prosodic pattern associated with the predetermined phrase using a statistical model, and to add the third prosodic pattern to a prosodic pattern set.

3. The apparatus of claim 1, further comprising a speech synthesis unit configured to apply speech synthesis to the text based on the restored prosodic pattern to generate synthetic speech.

4. The apparatus of claim 1, wherein the attribute information items each includes a surface expression which indicates a character string of the phrase, and the search unit searches for whether or not a surface expression of the predetermined phrase matches a surface expression of the phrase.

5. The apparatus of claim 1, wherein the attribute information items each includes a phoneme sequence which indicates a character string of the phoneme of the phrase, and the search unit searches for whether or not a phoneme sequence of the predetermined phrase matches a phoneme sequence of the phrase.

6. The apparatus of claim 1, wherein the attribute information items each includes a mora count of the phrase and an accent type of the phrase, and the search unit searches for whether or not a mora count of the predetermined phrase and an accent type of the predetermined phrase match a mora count of the phrase and an accent type of the phrase.

7. The apparatus of claim 1, wherein parameters of the first prosodic patterns each includes fundamental frequency of a phoneme, duration of the phoneme, and power of the phoneme, and the mapping unit independently maps one or more parameters of the fundamental frequency, the duration, and the power.

8. The apparatus of claim 1, wherein the first prosodic patterns are expressed by fundamental frequency of a phoneme, duration of the phoneme, and power of the phoneme, and the mapping unit couples and maps two or more parameters of the fundamental frequency, the duration, and the power.

9. The apparatus of claim 1, wherein if a second distance between the selected coordinates and the mapping coordinates is not more than a second threshold, the restoring unit obtains a fourth prosodic pattern before mapping the mapping coordinates as the restored prosodic pattern.

10. The apparatus of claim 1, further comprising a display configured to display the mapping coordinates.

11. The apparatus of claim 10, wherein the mapping unit clusters the mapping coordinates based on distances between the mapping coordinates, and determines representative points from each of clustered mapping coordinates, and the display displays the representative points.

12. The apparatus of claim 1, further comprising a second selection unit configured to select the phrase from a text.

13. The apparatus of claim 1, further comprising a normalization unit configured to normalize the second prosodic patterns respectively.

14. The apparatus according to claim 1, wherein the low-dimensional space is represented by few coordinates.

15. The apparatus according to claim 1, wherein the low-dimensional space is represented by one or more coordinates that is smaller than elements no less than the number of phonemes of the phrase.

16. A prosody editing method comprising:

storing, in a storage, attribute information items of phrases and one or more first prosodic patterns corresponding to each of the attribute information items of the phrases;

searching the storage for one or more second prosodic patterns corresponding to an attribute information item that matches an attribute information item of a predetermined phrase, the second prosodic patterns being included in the first prosodic patterns;

mapping each of the second prosodic patterns on a low-dimensional space to generate mapping coordinates, the mapping coordinates being used to suppress to suppress a first prosodic pattern which is not assumed normally, wherein a first distance between coordinates of the first prosodic pattern and coordinates of a target prosodic pattern is not within a first threshold;

obtaining coordinates selected from the mapping coordinates as selected coordinates;

restoring a second prosodic pattern according to the selected coordinates to obtain a restored prosodic pattern; and replacing prosody of synthetic speech generated based on the predetermined phrase by the restored prosodic pattern.

17. A non-transitory computer readable medium including computer executable instructions, wherein the instructions, when executed by a processor, cause the processor to perform a method comprising:

storing, in a storage, attribute information items of phrases and one or more first prosodic patterns corresponding to each of the attribute information items of the phrases;

searching the storage for one or more second prosodic patterns corresponding to an attribute information item that matches an attribute information item of a predetermined phrase, the second prosodic patterns being included in the first prosodic patterns;

mapping each of the second prosodic patterns on a low-dimensional space to generate mapping coordinates, the mapping coordinates being used to suppress a first prosodic pattern which is not assumed normally, wherein a first distance between coordinates of the first prosodic pattern being suppressed and coordinates of a target prosodic pattern is not within a first threshold;

obtaining coordinates selected from the mapping coordinates as selected coordinates;

restoring a prosodic pattern according to the selected coordinates to obtain a restored prosodic pattern; and replacing prosody of synthetic speech generated based on the predetermined phrase by the restored prosodic pattern.

* * * * *